US007399056B2

(12) United States Patent
Nakashima et al.

(10) Patent No.: US 7,399,056 B2
(45) Date of Patent: Jul. 15, 2008

(54) INKJET PRINTER

(75) Inventors: Atsuhisa Nakashima, Nagoya (JP); Susumu Kuzuya, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 267 days.

(21) Appl. No.: 10/921,137

(22) Filed: Aug. 19, 2004

(65) Prior Publication Data

US 2005/0041059 A1 Feb. 24, 2005

(30) Foreign Application Priority Data

Aug. 20, 2003 (JP) ..... 2003-296818

(51) Int. Cl.
*B41J 2/165* (2006.01)

(52) U.S. Cl. ..... 347/29; 347/30; 347/32; 347/33

(58) Field of Classification Search ..... 347/22–35, 347/104

See application file for complete search history.

(56) References Cited

U.S. PATENT DOCUMENTS 5,534,897 A * 7/1996 Anderson et al. ..... 347/32
6,578,945 B2 6/2003 Hashi et al.

FOREIGN PATENT DOCUMENTS

| | | |
|---|---|---|
| JP | A 07-186396 | 7/1995 |
| JP | A 2000-62151 | 2/2000 |
| JP | A 2002-120386 | 4/2002 |

* cited by examiner

*Primary Examiner*—Shih-wen Hsieh
(74) *Attorney, Agent, or Firm*—Oliff & Berridge, PLC

(57) ABSTRACT

During a restoring operation, a transport belt is bent by moving at least one of rollers around which the transport belt is looped, thereby forming a space which enables a maintenance unit to be inserted to an ink ejection surface of an inkjet head.

23 Claims, 7 Drawing Sheets

INKJET PRINTER

BACKGROUND OF THE INVENTION

1. Field of the Invention

The present invention relates to an inkjet printer which ejects ink onto a printing medium to form an image.

2. Description of the Related Art

In inkjet printers according to a related art, small ink droplets are ejected from plural ejection ports disposed in an inkjet head to conduct a printing operation. The inkjet printers according to the related art are classified into a serial head type printer and a line head type printer. The so-called serial head printer conducts a printing operation by a combination of a moving operation in a main scanning direction (the width direction of a sheet) in which an ink is ejected while moving the inkjet head in the main scanning direction, and an operation in which the sheet is moved in a sub-scanning direction. The so-called line head printer includes a line head having a printing width equal to the width of a sheet serving as a printing medium, and conducts a printing operation while relatively moving the line head and the sheet. In a line head printer, particularly, it is not required to move an inkjet head in the main scanning direction of a sheet. Hence, the printing speed can be made higher than that in a serial head printer.

In both the serial head printer and the line head printer according to the related art, in order to obtain an image of an excellent quality, ink ejection from minute nozzles disposed in the inkjet head must be kept in a satisfactory state. Therefore, a restoring operation is conducted to enable the nozzles to adequately eject small ink droplets. Examples of a restoring operation are a purging operation and a wiping operation. In the purging operation, ink in the inkjet head is discharged to evacuate foreign matters or air bubbles staying in ink flow paths. In the wiping operation, an ink ejection surface where ink ejection ports are disposed is wiped to remove excess ink droplets or foreign matters adhering to the ejection surface.

Such a serial head printer has a structure in which the inkjet head can be moved in the main scanning direction. Therefore, the purging operation or the wiping operation can be conducted after the inkjet head is retracted to a region, which is on an extended line in the main scanning direction and is outside the printing region.

However, an inkjet head of the line head type has an ink ejection surface, which is larger than that of an inkjet head of the serial head type. If a printer is configured so that such an inkjet head is horizontally moved to a region outside the printing region and a restoring operation is then conducted, the size of the printer is inevitably increased. In a line head ink-jet printer according to the related art, therefore, a maintenance unit, which conducts a restoring operation, is inserted between the inkjet head and a medium transporting device while an inkjet head is kept to be horizontally fixed, and the restoring operation is then conducted.

JP-A-2002-120386 (see pages 10-11; and FIG. 13) and JP-A-2000-62151 (see pages 5-6; and FIG. 1) disclose techniques of applying a restoring operation on an ink-jet head in a line head printer. In a printer disclosed in JP-A-2002-120386, when a restoring operation is to be conducted, a gap is formed between an inkjet head and a transport belt by moving the transport belt in a direction (downward direction) along which the transport belt is separated from the inkjet head, or by pressing down the upper face of the transport belt on a upstream or downstream side of the inkjet head in the medium transporting direction, and a maintenance unit is then inserted into the gap in a direction perpendicular to the medium transporting direction of the transport belt.

In the technique of JP-A-2000-62151, while one of two rollers around which a transport belt is wound and supported is used as an axis, the transport belt is swung so as to be separated together with the other roller from an inkjet head, thereby forming a space which enables a maintenance unit to face an ejection surface.

SUMMARY OF THE INVENTION

In the inkjet printer disclosed in JP-A-2002-120386, however, in order to form the configuration where the maintenance unit is inserted in the direction perpendicular to the medium transporting direction of the transport belt, a space where the maintenance unit waits during a period other than a period of the restoring operation must be formed in a lateral side of the transport belt. In the inkjet printer disclosed in JP-A-2000-62151, the transport belt in a stretched state is downward swung with using the one roller supporting the transport belt as an axis, from the position where the transport belt faces the ejection surface of the ink-jet head, thereby retracting the transport belt. Therefore, at least a space for enabling the stretched transport belt to be swung is required. Consequently, the JP-A-2002-120386 and JP-A-2000-62151 have a problem in that a printer is hardly miniaturized because the space required for moving a transport belt or that required for moving a maintenance unit must be ensured.

The invention provides an inkjet printer, which can solve the above-discussed problem, and in which a space in the printer can be effectively used so that the printer can be miniaturized.

In order to the above described problem, according to one embodiment of the invention, an inkjet printer includes an inkjet head, a transport belt, a first roller, a second roller, a first movement mechanism, a sealing member, a second movement mechanism, and a control unit. The inkjet head includes an ejection surface in which an ejection port that ejects ink is defined. The transport belt transports a printing medium. The transport belt is wound on the first and second rollers. The first movement mechanism moves the first roller between an operating position and a retracting position. The second movement mechanism moves the sealing member between a restoring position where the sealing member covers the ejection port of the ejection surface and a waiting position where the sealing member is separated from the ejection surface. The control unit controls the second movement mechanism to move the sealing member from the waiting position to the restoring position when the transport belt is located at the retracting position. When the first roller is located at the operating position, the first roller and the second roller support the transport belt so that the transport belt faces the ejection surface. The first roller located at the retracting position is closer to the second roller than the first roller located at the operating position.

With this configuration, the first roller located at the retracting position is closer to the second roller than the first roller located at the operating position. Therefore, the space where the transport belt is moved and the space where the transport is placed belt when the transport belt is retracted can be reduced in size. Hence, the inkjet printer can be miniaturized.

DETAILED DESCRIPTION OF THE PREFERRED EMBODIMENT

An inkjet printer of a preferred embodiment of the invention will be described.

In an inkjet printer according to one embodiment of the invention, the maintenance unit conducts the restoring operation in order to restore the inkjet head to a normal state. At this time, the transport belt which faces the ejection surface during a printing operation must be retracted so as to be separated from the ejection surface, thereby forming a space where the maintenance unit faces the ejection surface of the inkjet head.

In the inkjet printer according to one embodiment of the invention, in order to retract the transport belt, the transport belt is bent by moving at least one of the rollers around which the transport belt is wound, thereby retracting the transport belt. Since the transport belt is retracted by bending, the degree of freedom of the path of moving the transport belt can be enhanced, and the space for moving the transport belt can be reduced in size as compared with the case where a transport belt stretched around two rollers is retracted without being bent. Moreover, the space which is occupied by the transport belt in the retracted state can be reduced in size. The maintenance unit can be retracted in a position which is close to the ejection surface. Hence, also the space for moving the maintenance unit can be reduced in size. Therefore, the whole size of an inkjet printer can be miniaturized.

Embodiment 1

Hereinafter, a preferred embodiment of the invention will be described with reference to the accompanying drawings.

Figure 1:
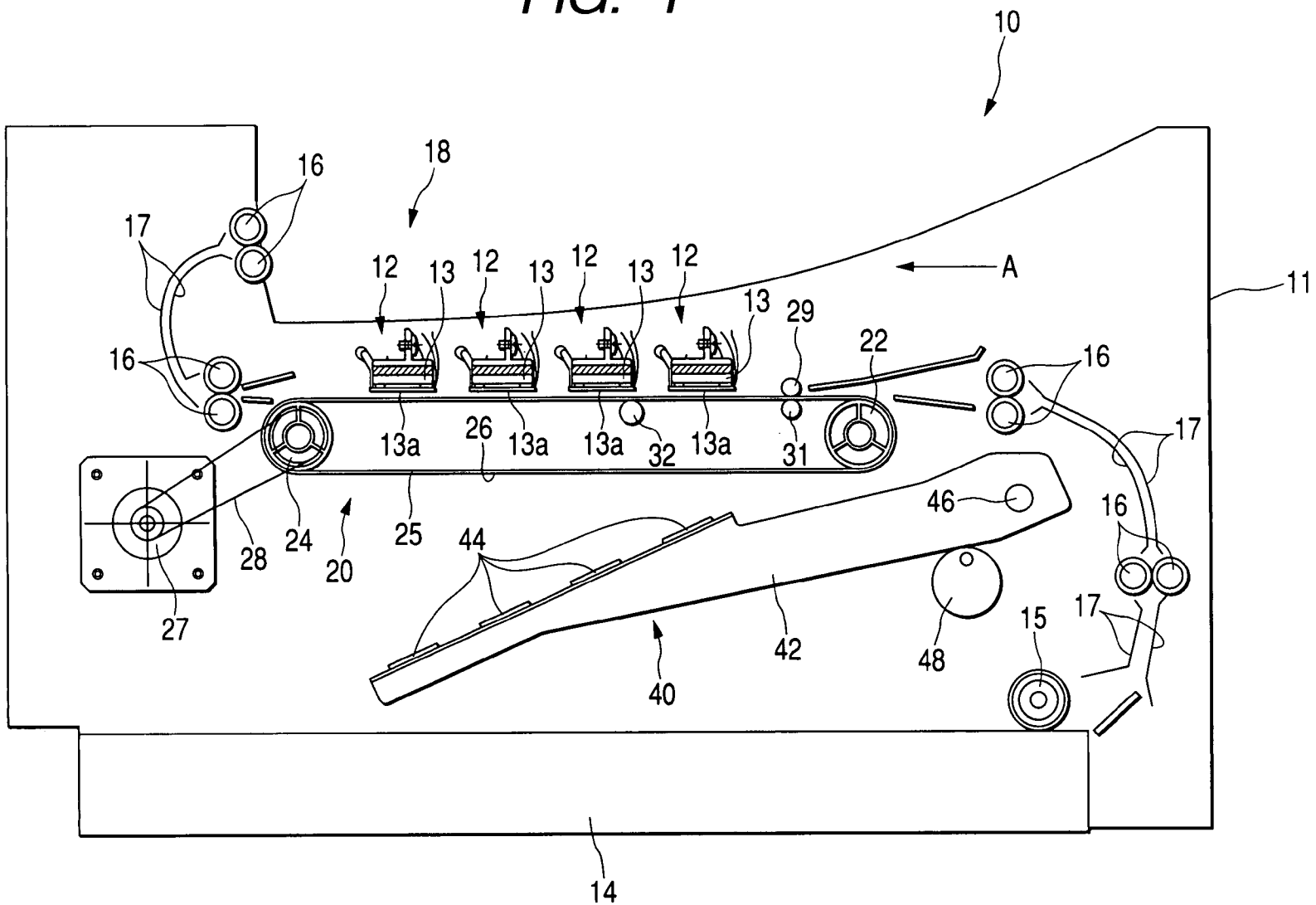
FIG. 1 is a side view showing the whole configuration of an inkjet printer of Embodiment 1.

(Outline of configuration of printer) First, an ink-jet printer of Embodiment 1 of the invention will be described with reference to FIGS. 1 and 2. FIG. 1 is a side view showing the outline of configuration of an inkjet printer 10 according to the embodiment 1. FIG. 2 is a diagram illustrating the configuration and operation of a roller moving mechanism 34 in the embodiment 1.

The inkjet printer 10 shown in FIG. 1 is a color inkjet printer of the line head type having four line type inkjet heads 12 which are placed in a case 11. In other words, the inkjet printer is an inkjet printer of the line printing type in which, during a printing operation, the inkjet heads 12 are positionally fixed and form an image on a printing medium transported by a transport unit 20 that will be described later. A sheet supply tray 14 is disposed in a lower portion of the case 11 of the ink-jet printer 10. A sheet discharge tray 18 is disposed in an upper portion of the inkjet printer 10. The transport unit 20 having a transport belt 25 is disposed in a middle portion of FIG. 1*e*. A process of forming an image is conducted while transporting a sheet serving as a printing medium so as to pass below the inkjet heads 12. The inkjet printer 10 includes a movable maintenance unit 40, which conducts a restoring operation of restoring head bodies 13 of the inkjet heads 12 to a normal state.

(Image forming mechanism) Each of the four ink-jet heads 12 has the head body 13 in its lower end. Each of the head bodies 13 is formed by bonding together a flow path unit in which ink flow paths each including a pressure chamber are formed, and an actuator unit which pressurizes ink in each of the pressure chambers. The head bodies 13 have a rectangular section shape, and are arranged in close proximity to one another so that their longitudinal directions are perpendicular (in the direction perpendicular to the paper of FIG. 1) to the sheet transporting direction (the medium transporting direction: the direction of the arrow A in FIG. 1). The bottom faces (ejection faces 13*a*) of the four head bodies 13 face a sheet transport path. Many ejection ports of a small diameter corresponding to nozzles are disposed in each of the ejection faces 13*a*. Inks of magenta (M), yellow (Y), cyan (C), and black (K) are ejected from the four head bodies 13, respectively.

The inkjet heads 12 are placed so that small gaps are formed between the respective ejection faces 13*a* and the transport belt 25. The sheet transport path is defined in the gap portion. According to this configuration, when a sheet transported on the transport belt 25 is passed immediately below the four head bodies 13, the color inks are ejected from the ink ejection ports toward the upper face (printing face) of the sheet, whereby a desired color image is formed on the sheet.

In the inkjet printer 10, a restoring operation is conducted to maintain the ink ejection from the minute nozzles disposed in the inkjet heads 13 to a satisfactory level. The restoring operation is conducted at a timing such as that when ink is initially introduced from an ink source (not shown) to one of the inkjet heads 12, or that when the printer 10 has not been used for a long term and the operation of the printer is then resumed. The restoring operation is mainly composed of a purging operation and a capping operation. The purging operation applies a pressure to the ink in the inkjet head 12 to remove the ink from the ejection ports. The capping operation, when the printing operation is not conducted, sets the ejection faces 13*a* to a sealed state in order to prevent ink in the vicinity of the ejection ports from drying.

In the embodiment, the purging operation and the capping operation are conducted by the maintenance unit 40 which will be described later. The maintenance unit 40 is configured so as to be movable between a waiting position and a restoring position. At the waiting position, the maintenance unit 40 is separated from the ejection faces 13*a*. At the restoring position shown in FIG. 3C described later, the maintenance unit 40 faces the ejection faces 13*a*.

(Configuration of sheet transport system) Sheets are stacked on the sheet supply tray 14. A sheet supply roller 15 feeds out the uppermost one of the stacked sheets. The sheet fed out by the sheet supply roller 15 is further fed to the transport unit 20 by feed rollers 16 disposed in the sheet transport path while being guided by a guide frame 17 forming the sheet transport path. Then, an image is formed by the inkjet heads 12 on the sheet P while the sheet P is carried by the transport belt 25 of the transport unit 20. The sheet is then discharged onto the sheet discharge tray 18 by feed rollers 16 while being guided by a guide frame 17.

(Configuration of transport unit) The transport unit 20 includes a first roller 22, a second roller 24, and a transport belt 25 which is wound around the two rollers. The first roller 22 is rotatably supported at the ends by a frame 30 (functioning as a roller support member, see FIG. 2). A drive belt 28 for transmitting the driving force of a transport motor 27 is wound around the second roller 24 functioning as a driving roller, so that the second roller 24 rotates in accordance with rotation of the transport motor 27. The rotation of the second roller 24 provides the transport belt 25 with a rotational force. The first roller 22 is a driven roller, which is rotated by the rotational force of the transport belt 25.

The transport belt 25 is an endless belt, which is made of a flexible material such as rubber and is formed into a loop-like shape. In the transport belt 25, the outer peripheral face 26 is treated with silicon rubber. Thus, a transported sheet can be further transported by the driving of the second roller 24 toward the downstream side in the medium transporting direction (toward the left side in FIG. 1) while the sheet is held onto the outer peripheral face 26 by its adherence.

When a printing operation is to be conducted, as shown in FIG. 1, the first roller 22 is located at a position (operating position) so that the transport belt 25 maintains a state (facing state) in which the outer peripheral face 26 of the transport belt 25 is located at a position (facing position) where the outer peripheral face 26 faces the ejection faces 13*a*. By contrast, when the restoring operation, which will be described later, is to be conducted, the first roller 22 is moved to a retracting position by the roller moving mechanism 34 in order to separate the transport belt 25 from the ejection faces 13*a*. When the first roller 22 is located at the operating position, the transport belt 25 is wound around the first roller 22 and the second roller 24 under tension.

Figure 2A:
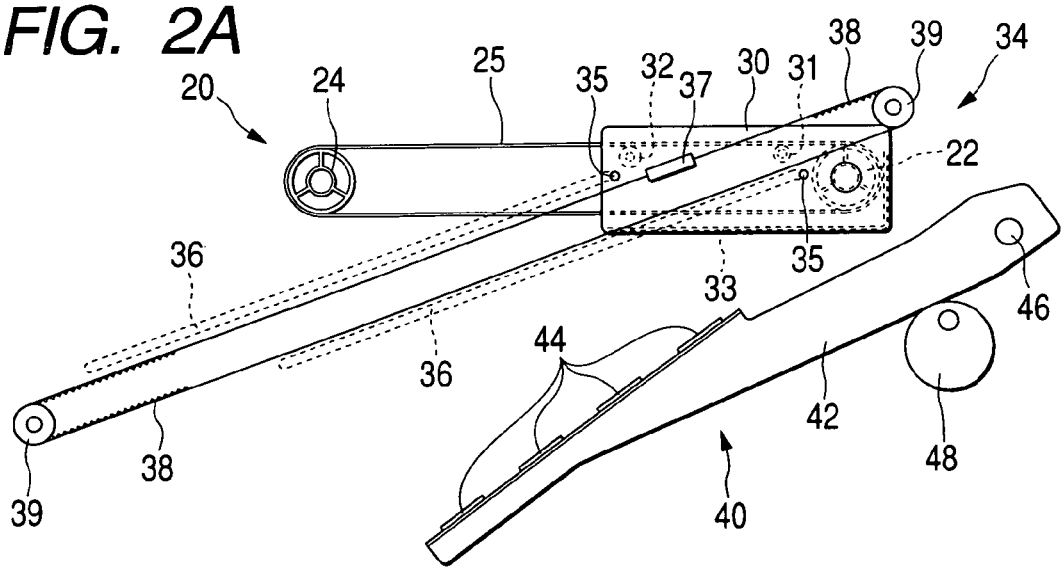
FIG. 2 is a diagram illustrating the configuration and operation of a roller moving mechanism in Embodiment 1.

As shown in FIG. 2A, a belt support roller 31 is disposed in the frame 30. In the transport unit 20, a press roller 29 (see FIG. 1) is disposed at a position corresponding to that of the belt support roller 31 when the transport belt 25 is located at the facing position. The press roller 29 is urged toward the outer peripheral face 26 of the transport belt 25 by a spring mechanism which is not shown. Therefore, a sheet is pressed against the outer peripheral face 26 of the transport belt 25 by the press roller 29 and the belt support roller 31, so that the sheet is prevented from raising from the outer peripheral face 26, thereby enabling the sheet to be surely transported with adhering to the face 26.

As shown in FIG. 2A, a belt guide roller 32 is disposed in the frame 30. When the transport belt 25 is located at the facing position, the belt guide roller 32 supports the inner peripheral face of the transport belt 25, in the same manner as the belt support roller 31. When the first roller 22 is moved from the operating position to the retracting position, the belt guide roller 32 makes contact with the inner peripheral face of the transport belt 25 to function as a guide member, which guides a bent state of the transport belt 25. When the first roller 22 is moved from the operating position to the retracting position, the transport belt 25 is bent. In the case where the belt guide roller 32 is not disposed, there is the possibility that the transport belt 25 makes contact with the maintenance unit 40 depending on the bending direction of the belt. However, this problem can be avoided by causing the bending direction of the transport belt 25 to be guided by the belt guide roller 32.

Figure 2B:
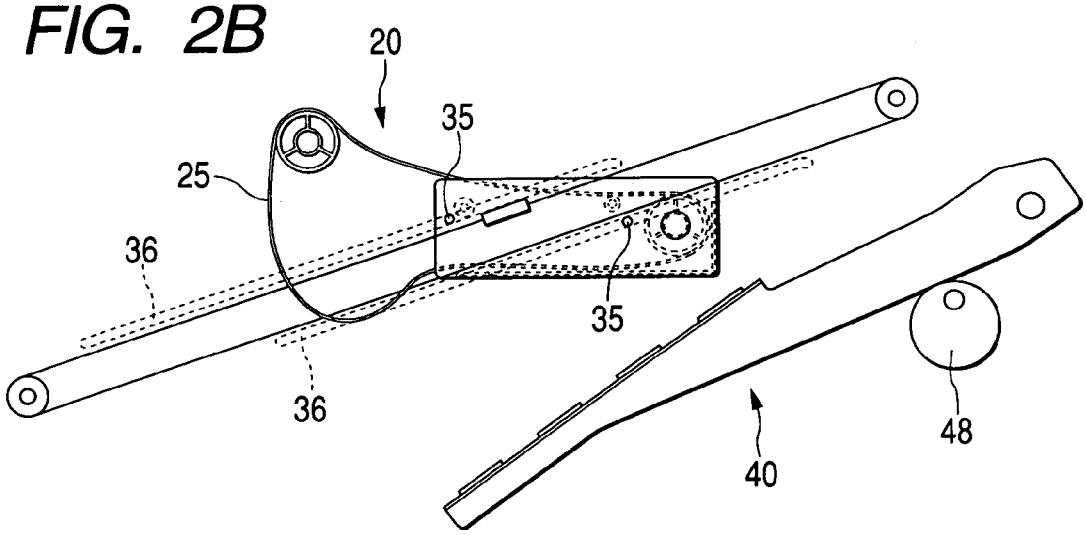

A belt support member 33, which when the first roller 22 is moved from the operating position to the retracting position, supports the transport belt 25 from the lower side is disposed in the frame 30. As shown in FIG. 2B, the belt support member 33 can prevent the bent transport belt 25 from contacting with the maintenance unit 40. Hence, ink adhering to the maintenance unit 40 can be prevented from being transferred to the transport belt 25.

(Roller moving mechanism) Next, the roller moving mechanism 34 will be described with reference to FIG. 2. When the restoring operation is to be conducted with respect to the ejection faces 13*a* of the inkjet heads 12, the roller moving mechanism 34 moves the first roller 22 from the operating position to the retracting position in order to separate the transport belt 25 from the position (facing position) where the belt faces the ejection faces 13*a*.

The roller moving mechanism 34 is a mechanism that moves the frame 30 on which the first roller 22 is pivoted. The roller moving mechanism 34 includes guide pins 35 guide rails 36, a movement belt 38, and a pair of belt pulleys 39. The guide pins 35 are disposed in the frame 30. The guide rails 36 is engaged with the guide pins 35 to guide the guide pins 35 in the moving direction. The movement belt 38 is fixed to the frame 30 by a fixing member 37 and transmits a driving force for moving the frame 30. The movement belt 38 is wound around the pair of belt pulleys 39.

The guide rails 36 are members in each of which a groove having a diameter that is larger than the diameter of the corresponding guide pin 35 is formed, and are disposed in both sides of the case 11 in the width direction of the transport belt 25, respectively. One of the belt pulleys 39 is driven by a pulley motor 82.

Figure 2C:
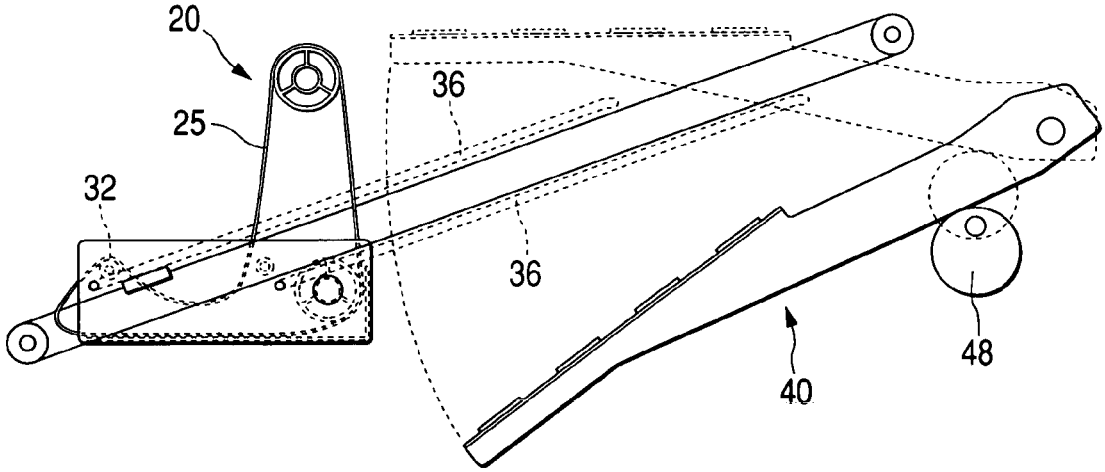

As shown in FIG. 2A, the first roller 22 is pivoted on the frame 30, so that, when the movement belt 38 is driven, the first roller 22 is moved together with the frame 30. As shown in FIGS. 2A to 2C, the guide rails 36 guide the guide pins 35 disposed in the frame 30, whereby the first roller 22 is moved along a movement path, which is determined by the arrangement of the guide rails 36. At this time, the belt guide roller 32 guides the bent state of the transport belt 25, so that the transport belt 25 can be prevented from contacting with the maintenance unit 40. The roller moving mechanism 34 functions also as a guide moving mechanism that moves the belt guide roller 32.

In the embodiment 1, when the guide pins 35 abut against the right ends of the guide rails 36 in FIGS. 2A to 2C, the first roller 22 is located at the operating position. When the guide pins 35 abut against the left ends in FIGS. 2A to 2C, the first roller 22 is located at the retracting position.

As shown in FIG. 2C, the retracting position of the first roller 22 is requested only to satisfy the following two conditions. Firstly, when the first roller 22 is located at the retracting position, the first roller 22 is at least separated from a region (maintenance-unit moving region) in which the maintenance unit 40 is moved to the position where the maintenance unit faces the ejection faces 13*a*. Secondly, when the first roller 22 is located at the retracting position, the transport belt 25 is separated from the ejection faces 13*a*. When the distance by which the first roller 22 is separated from the moving region of the maintenance unit 40 is set minimum, it is possible to reduce the space required for installing the inkjet printer 10. When the retracting position of the first roller 22 is set to be on the upstream side of the second roller 24 in the direction from the first roller 22 to the second roller 24 (in the embodiment 1, the medium transporting direction) in a state where the transport belt 25 is in the facing state, it is possible to reduce the space, which is on the downstream side (the left side in FIG. 1) of the second roller 24 in the transporting direction and is required for retracting the first roller 22. Therefore, the space required for installing the inkjet printer 10 can be reduced.

(Maintenance unit) Next, the configuration of the maintenance unit 40 in the embodiment 1 will be described with reference to FIGS. 2 and 3. FIG. 3 is a diagram illustrating the operations of the mechanisms when the restoring operation is conducted.

The maintenance unit 40 includes a frame 42, caps 44, and a rotation shaft 46, which rotatably supports one end of the frame 42.

The four caps 44 corresponding to the four ink-jet heads 12 are disposed in a part of the upper face of the frame 42. Each of the caps 44 is made of an elastic material such as rubber, and can cover the ink ejection port group of the ejection face 13*a* of the corresponding inkjet head 12 so as to be in close contact therewith in a hermetical manner. Tubes which are not shown are connected to the caps 44, respectively. When inks in the inkjet heads 12 are pressurized to conduct pressure purging in order to discharge the ink, the inks are discharged through the tubes to be discarded in a waste ink tank, which is not shown. Alternatively, the purging may be conducted by suction purging in which a pump is connected to the tubes and inks in the inkjet heads 12 are sucked and discharged with using a suction force generated by driving the pump.

A cam 48 (functions as a unit moving mechanism), which is coupled to a cam motor 80, is disposed below the frame 42 and at a position where the peripheral face of the cam 48 abuts against the bottom face of the frame 42. When the cam 48 is swung by the driving force of the driving motor 80, the frame 42 is swung about the rotation shaft 46 serving as a fulcrum. Therefore, the maintenance unit 40 can be moved between the restoring position (see FIGS. 2C and 3C) where the caps 44 face the ejection faces 13*a* and the waiting position (see FIGS. 2A and 3A) where the caps 44 are separated from the ejection faces 13*a*.

As shown in FIG. 1, the waiting position of the maintenance unit 40 is a position where, when the transport belt 25 is in the facing state, the maintenance unit 40 faces the outer peripheral face 26 of the transport belt 25 on the side (lower side) which is opposite to the side facing the ejection faces 13*a* as viewing from the first roller 22 and the second roller 24. When the waiting position is set so as to cause the maintenance unit 40 to face the transport belt 25 as described above, it is possible to reduce the size of the maintenance-unit moving region.

Figure 7:
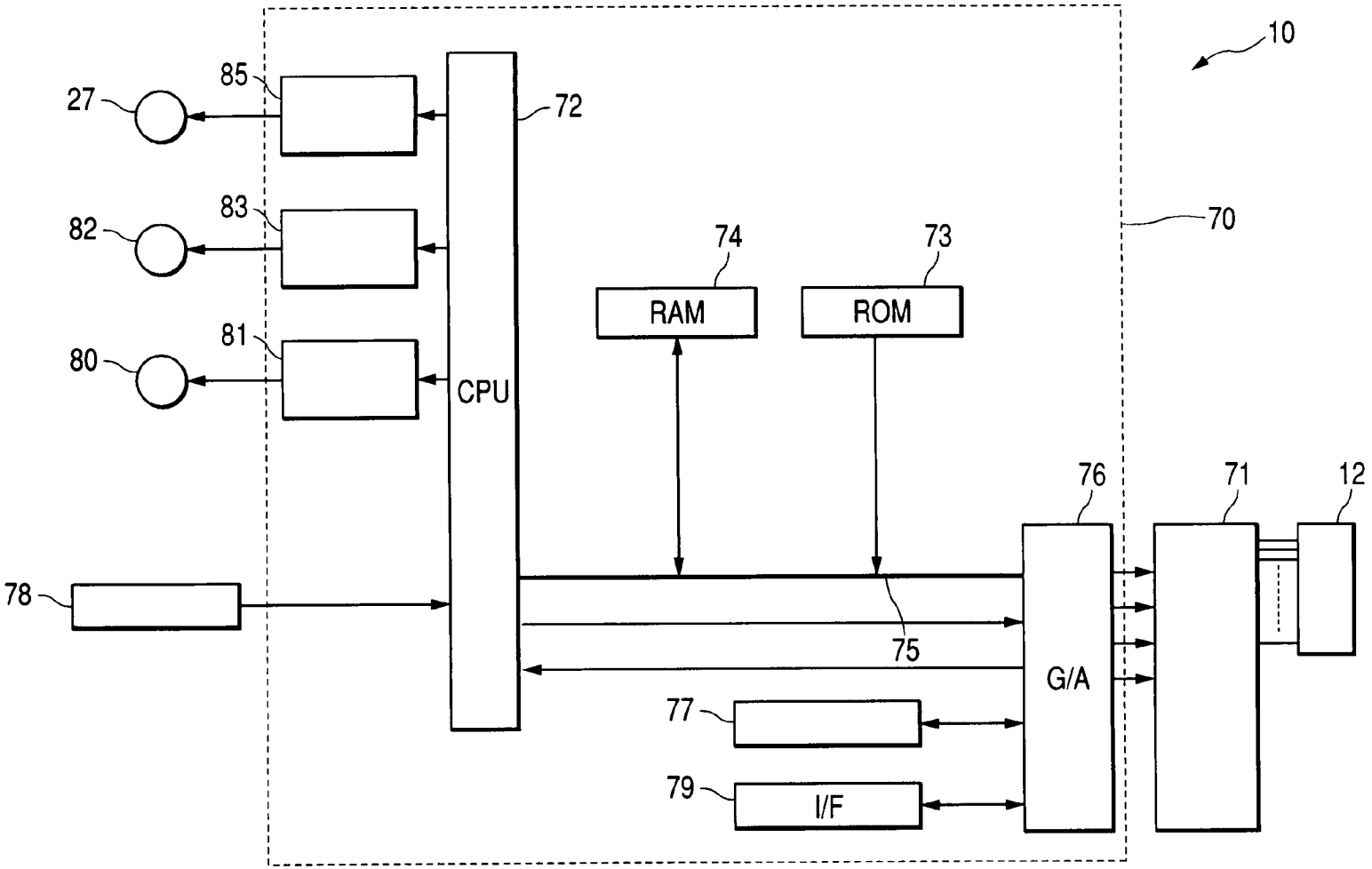
FIG. 7 is a block diagram showing the outline of the electric circuit configuration of the inkjet printer 10.

(Control unit) FIG. 7 is a block diagram showing the outline of the electric circuit configuration of the inkjet printer 10. A control unit for controlling the inkjet printer 10 includes a main control board 70, and a sub-control board 71 for controlling the inkjet heads 12. The main control board 70 is mounted with a microcomputer (CPU) 72, a ROM 73, a RAM 74, an image memory 77 and a gate array (G/A) 76. The CPU 72 has a one-chip configuration. The ROM 73 is a read-only memory for storing fixed-value data including various control programs to be executed by the CPU 72, judgment tables and the like. The RAM 74 is a rewritable memory for temporarily storing various data and the like.

The CPU 72 executes various processes in accordance with the control programs stored in ROM 73 in advance. In addition, the CPU 72 generates a printing timing signal and a reset signal, and transfers the signals to the G/A 76, which will be described later. An operation panel 78, a drive circuit 85, a drive circuit 83, a drive circuit 81, etc. are connected to the CPU 72. A user gives instructions for printing and the like through the operation panel 78. The drive circuit 85 drives the transport motor 27 for rotating the second roller 24. The drive circuit 83 drives a pully motor 82 for rotating the belt pulley 39. The drive circuit 81 operates the cam motor 80 for rotating the cam 48. The CPU 72 controls the operation of each device connected thus.

The G/A 76 outputs print data (driving signal), a transfer clock, a latch signal, a parameter signal and an ejection timing signal in accordance with the printing timing signal transferred from the CPU 72 and image data stored in the image memory 77. The image data is printed on the recording medium based on the print data. The transfer clock is synchronized with the print data. A reference printing waveform signal is generated from the parameter signal. The ejection timing signal is output in a constant period. The G/A 76 transfers those signals to the sub-control board 71 mounted with a head driver.

In addition, the G/A 76 stores image data into the image memory 77. The image data is transferred from external equipment such as a computer through an interface (I/F) 79. The G/A 76 generates a data reception interrupt signal based on data transferred from a host computer or the like through the I/F 79, and transfers the signal to the CPU 72. The ROM 73, the RAM 74 and the G/A 76 are connected to the CPU 72 through a bus line 75.

The sub-control board 71 is a board for driving the inkjet heads 12 by a head driver (drive circuit) mounted on the sub-control board 71. The head driver is controlled through the G/A 76 mounted on the main control board 70, so as to apply a drive pulse of waveform corresponding to a recording mode to each drive element of the recording heads. Thus, a predetermined amount of ink is ejected.

(Restoring operation) Next, the restoring operation of the thus configured maintenance unit 40 will be described with reference to FIG. 3. During the restoring operation, the control unit controls the operations of the roller moving mechanism 34 and the unit moving mechanism.

Figure 3A:
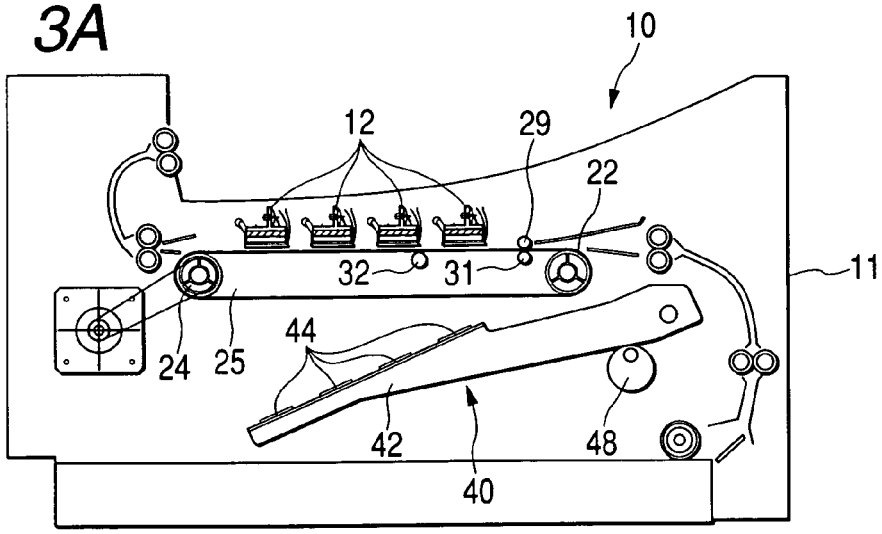
FIG. 3 is a diagram illustrating the operations of mechanisms when a restoring operation is conducted in Embodiment 1.

FIG. 3A shows a state where the printing operation is conducted. In this state, the first roller 22 is located at the operating position so that the outer peripheral face 26 of the transport belt 25 faces the ejection faces 13*a*. The maintenance unit 40 is located at the waiting position where the maintenance unit 40 faces the outer peripheral face 26 of the transport belt 25, which is opposite to the outer peripheral face 26 facing the ejection faces 13*a*. In this arrangement, a sheet is transported, and an image is then formed by the ink-jet heads 12.

Figure 3B:
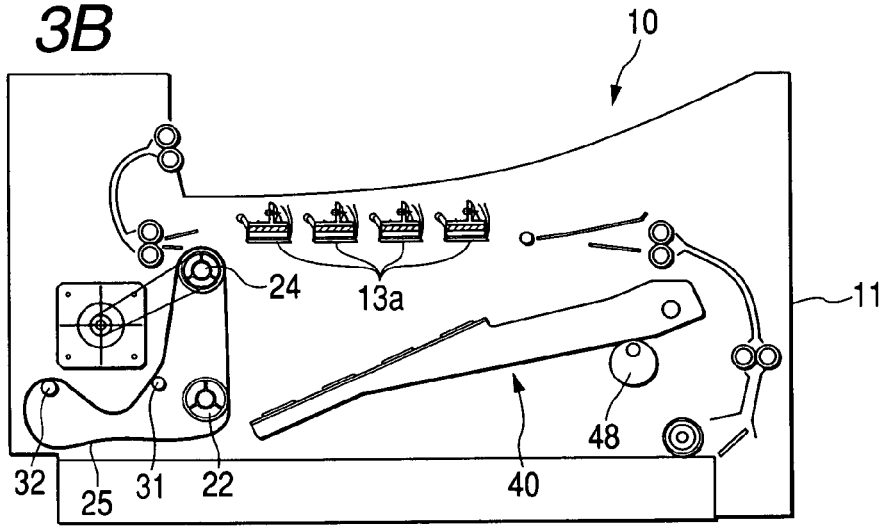

When the restoring operation is to be conducted, the first roller 22 is first moved from the operating position to the retracting position as described above, and the transport belt 25 is separated from the ejection faces 13*a* as shown in FIG. 3B, and also from the maintenance-unit moving region.

Figure 3C:
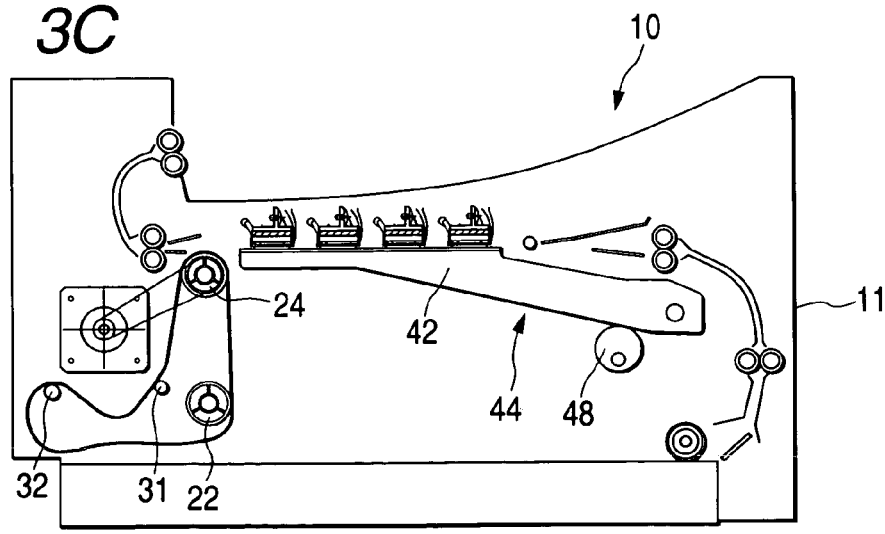

Next, the cam 48 is swung to push up the frame 42 of the maintenance unit 40. As shown in FIG. 3C, the maintenance unit 40 is moved to the position where the caps 44 face and are in close contact with the ejection faces 13*a* of the inkjet heads 12. Under this state, the inkjet heads 12 conduct the purging operation in which the pressures of the ink flow paths are raised and inks in the nozzles are ejected into the caps 44. When the purging operation is ended, the maintenance unit 40 is fixed to the current position until the printing operation is started, to conduct a capping operation in which the state where the caps 44 are in close contact with the ejection faces 13*a* is maintained to prevent the inks in the nozzles from drying.

As described above, in the inkjet printer 10 of the embodiment 1, the transport belt 25 is bent by moving the first roller 22, in order to form the space for enabling the maintenance unit 40 to face the ejection faces 13*a*. Therefore, the space required for separating the transport belt 25 from the position facing the ejection faces 13*a* can be reduced as compared with the case where the transport belt 25 is moved without being bent. Moreover, the waiting position of the maintenance unit 40 can be made closer to the ejection faces 13*a*. Therefore, the internal space of the inkjet printer 10 can be effectively used, so that the printer can be miniaturized.

In the embodiment 1, the movement path of the first roller 22, which is defined by the guide rails 36, is formed into a linear shape elongating in the direction (downward direction)

along which, as the first roller 22 approaching to the second roller 24, the first roller 22 is separated from the ejection faces 13*a*. Alternatively, the movement path may have a curved shape or a shape which is formed by combining straight and curved lines. In consideration of the position where the maintenance unit 40 is placed, preferably, the guide rails 36 are placed in a shape which enables the inkjet printer 10 to be miniaturized.

Figure 4A:
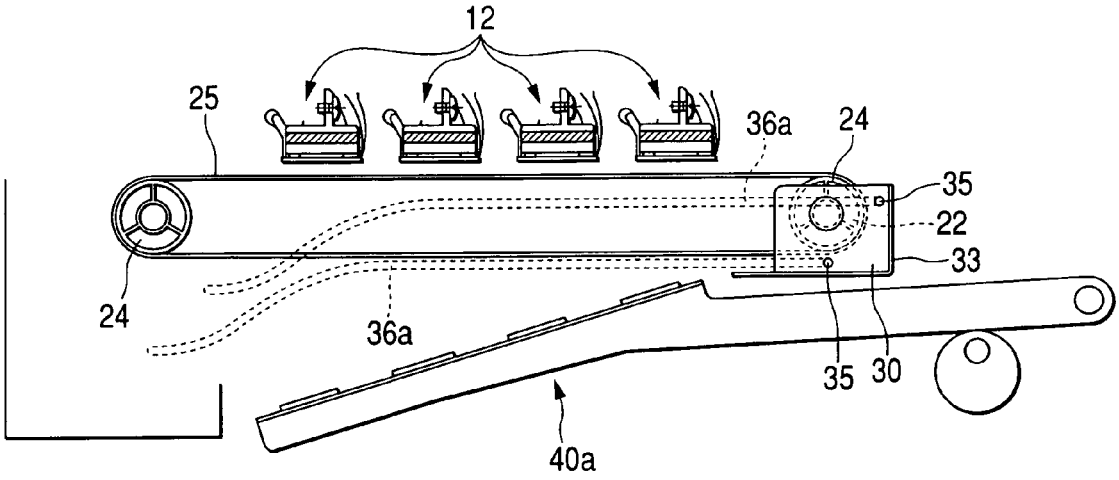
FIG. 4 is a diagram showing a modification of Embodiment 1.
Figure 4B:
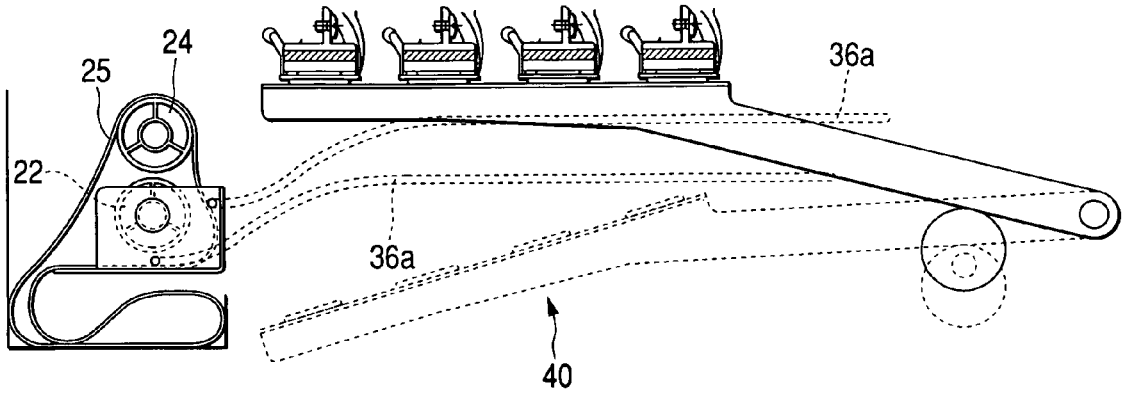

FIG. 4 is a diagram showing a modification of Embodiment 1. FIG. 4A shows a state where the transport belt 25 is in the facing state. FIG. 4B shows a state where the belt 25 is separated from the ejection faces 13*a*. In the modification shown in FIG. 4, in a view of projection in the width direction of the transport belt 25, guide rails 36*a* have a shape of a curved line, which is convex toward the ejection faces 13*a*. In this case, the movement path of the first roller 22 (the frame 30), which is defined by the guide rails 36*a*, can be made closer to the ejection faces 13*a*. The waiting position of a maintenance unit 40*a* can be placed nearer the ejection faces 13*a* as compared with the case where the guide rails 36*a* are formed into a linear shape. As a result, the inkjet printer 10 can be miniaturized.

Figure 5A:
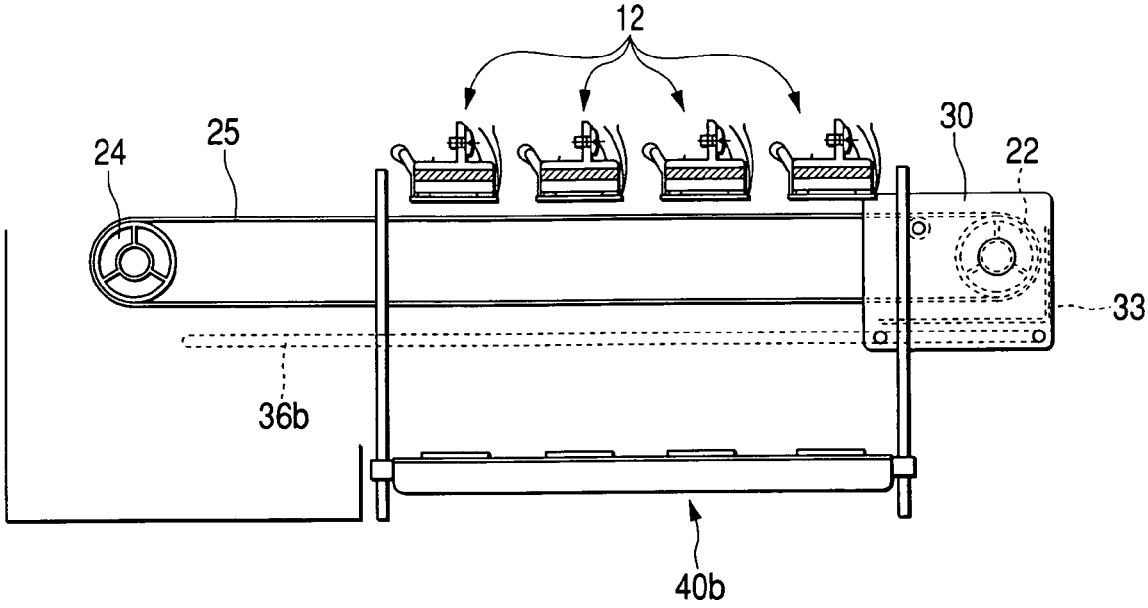
FIG. 5 is a diagram showing another modification of Embodiment 1.
Figure 5B:
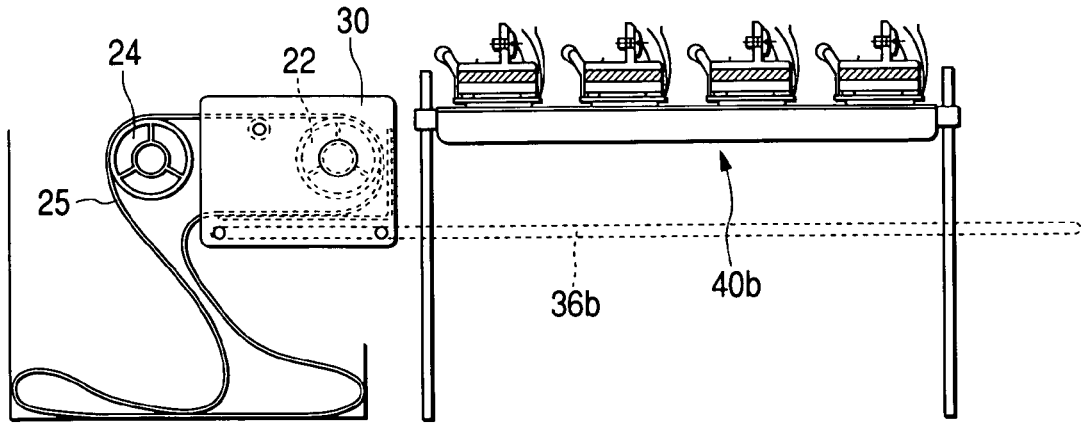

FIG. 5 is a diagram showing another modification of Embodiment 1. FIG. 5A shows a state where the transport belt 25 is in the facing state. FIG. 5B shows a state where the belt 25 is separated from the ejection faces 13*a* (FIG. 5B). In the modification shown in FIG. 5, the movement path of the first roller 22, which is defined by guide rails 36*b*, is formed along a direction (parallel to the ejection faces 13*a*) along which the first roller 22 is directed toward the second roller 24. In this case, the first roller 22 is moved with a distance between the first roller and the ejection faces 13*a* being constant. Therefore, the waiting position of a maintenance unit 40*b* can be made closer to the ejection faces 13*a* so long as the transport belt 25, which is bent when the roller is retracted, is not in contact with the maintenance unit 40*b*.

In the example shown in FIG. 5, the maintenance unit 40*b* is moved in a direction (vertical direction) perpendicular to the ejection faces 13*a*. In this way, the configuration of the unit moving mechanism, which moves the maintenance unit between the waiting position and the restoring position, is not restricted to that described above. The unit moving mechanism can be adequately modified as far as the maintenance unit can be moved from the waiting position to the restoring position.

In the embodiment 1, only the first roller 22 is moved. Alternatively, also the second roller 24 may be moved relatively to the first roller 22 so that the transport belt 25 is bent and separated from the ejection faces 13*a*.

Embodiment 2

Next, another preferred embodiment of the invention, which is different from Embodiment 1, will be described with reference to FIG. 6. FIG. 6 is a diagram showing main portions of an inkjet printer 100 of Embodiment 2. In the following description, components identical with those of Embodiment 1 are denoted by the same reference numerals, and their detailed description may be omitted.

Figure 6A:
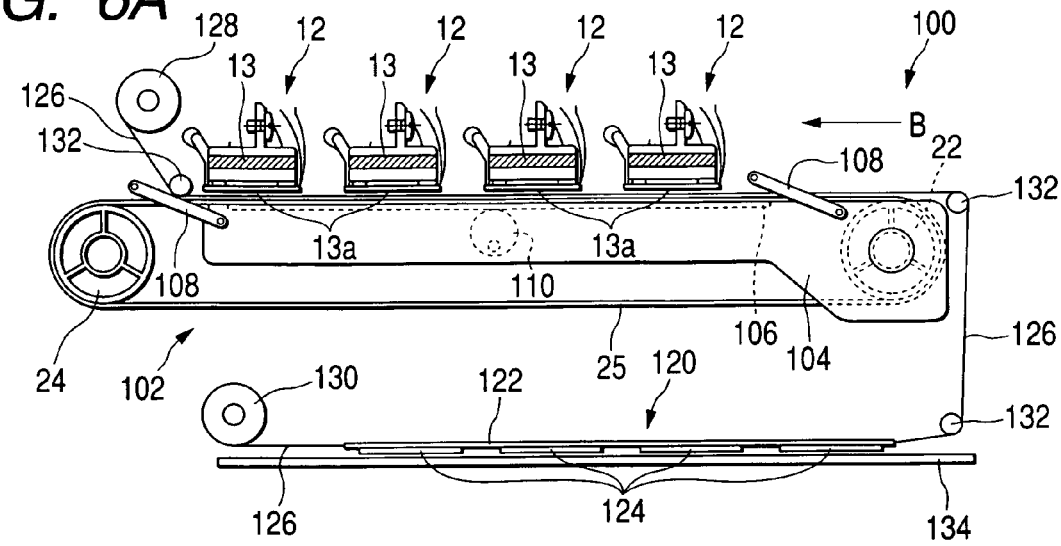
FIG. 6 is a diagram illustrating the operations of mechanisms when a restoring operation is conducted in Embodiment 2.

As shown in FIG. 6A, the inkjet printer 100 includes a transport unit 102 and a movable maintenance unit 120. The transport unit 102 transports a sheet by means of the transport belt 25. The movable maintenance unit 120 conducts a restoring operation of restoring the head bodies 13 of the inkjet heads 12 to a normal state.

Of the first roller 22 and the second roller 24 around which the transport belt 25 is wound, the second roller 24 is a driving roller to which a driving force is transmitted from a driving motor 27 to conduct a driving operation; and the first roller 22 is a driven roller, which is rotatably supported at the ends by a frame 104.

In the frame 104 that supports the first roller 22, a flat plate-like belt support member 106, which supports the transport belt 25 from the inner peripheral face side, is disposed. The frame 104 is movably supported by strip-like link members 108. The frame 104 is moved by a cam 110, which is disposed below the belt support member 106 and is rotated with being contacted with the lower face of the belt support member 106. Therefore, the roller moving mechanism, which moves the first roller 22 from the operating position to the retracting position, is realized by the link members 108 and the cam 110. When the restoring operation is to be conducted with respect to the head bodies 13 of the inkjet heads 12, the first roller 22 is moved by the function of the roller moving mechanism from the operating position shown in FIG. 6A to the retracting position shown in FIG. 6B.

In the maintenance unit 120, caps 124 for covering the ejection faces 13*a* are integrally formed on a flexible elastic sheet 122. The caps 124 are made of the same material as the elastic sheet 122. Each of the caps 124 can cover the ink ejection port group of the ejection face 13*a* of the corresponding inkjet head 12 so as to be in close contact therewith in a hermetical manner, thereby preventing the inks in the head body 13 from drying.

Two wires 126 are embedded into the ends of the elastic sheet 122 in the width direction so as to elongate in the medium transporting direction (the direction of the arrow B in FIG. 6), respectively. The elastic sheet 122 is fixed to the wires 126. The ends of each of the two wires 126 are fixed to two bobbins 128 and 130, respectively. The wires 126 are stretched between the bobbins 128 and 130 while being guided by guide rollers 132 so as not to be in contact with the transport unit 102. When the bobbin 128 or 130 is rotated by a driving force of a motor which is not shown, the maintenance unit 120 can be moved between the restoring position and the waiting position. Accordingly, the unit moving mechanism is configured by the bobbins 128 and 130 and the motors, which drive the bobbins and are not shown.

The control unit controls the operations of the roller moving mechanism and the unit moving mechanism.

An ink absorbing member 134 is disposed at a position where the ink absorbing member 134 faces the caps 124 of the maintenance unit 120 located at the waiting position, so as to absorb ink dripping from the caps 124.

Figure 6B:
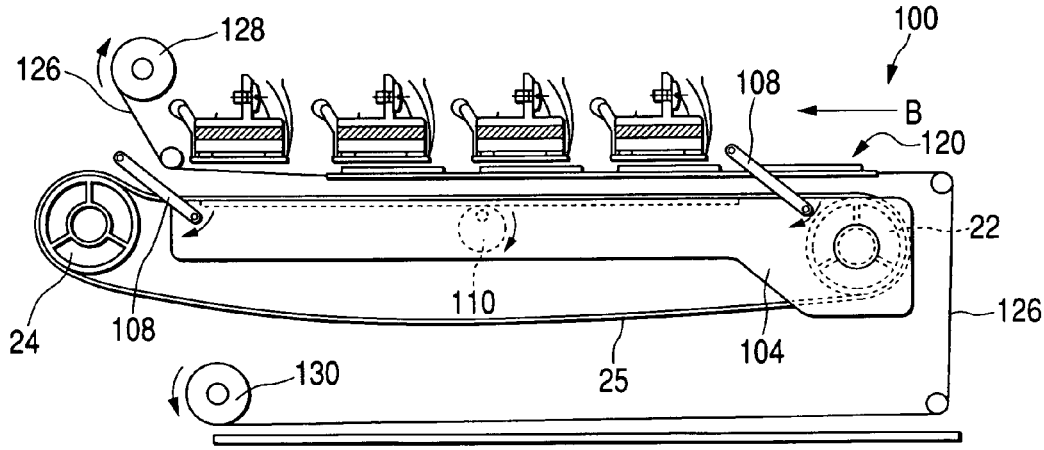
Figure 6C:
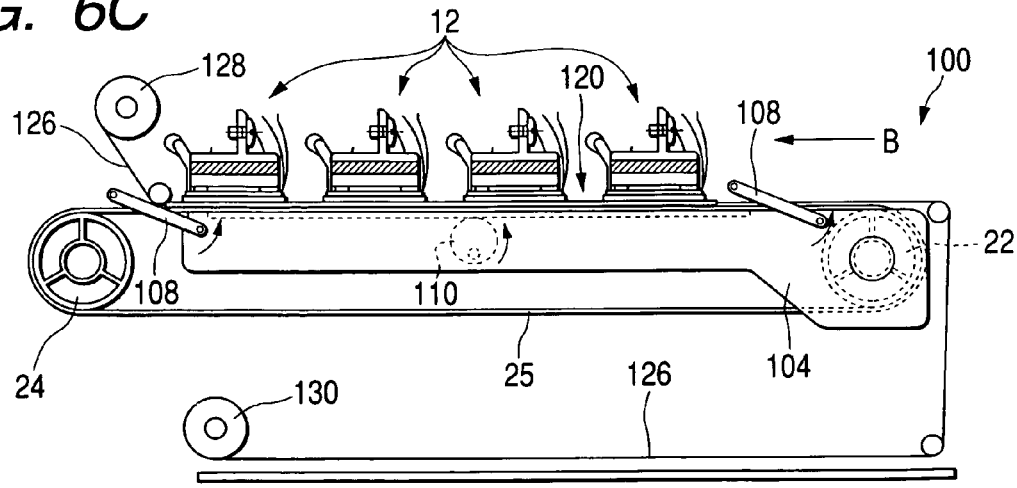

In the thus configured inkjet printer 100, the restoring operation is conducted in the following manner. First, the cam 110 is swung, so that the first roller 22 is moved to the retracting position as shown in FIG. 6B. In accordance with the movement of the first roller 22 to the retracting position, the transport belt 25 is bent to be separated from the ejection faces 13*a*, thereby forming a space which enables the maintenance unit 120 to be inserted to the restoring position. Even when the first roller 22 is downward moved by a small distance, the bending of the transport belt 25 ensures the space required for inserting the maintenance unit 120 to the restoring position.

Next, the bobbin 128 is rotated by the driving motor which is not shown, to take up the wire 126, so that the maintenance unit 120 is inserted to the restoring position from the first roller 22 side.

When the maintenance unit 120 reaches the restoring position and stops as shown in FIG. 6C, the cam 110 is again swung and the frame 104 is raised. The maintenance unit 120, which is inserted between the transport belt 25 and the ejection faces 13*a*, is pressed against the ejection faces 13*a*, and the caps 124 are coverlingly closely contacted with the ejection faces 13*a*, respectively. The maintenance unit 120 is fixed to the current position until the printing operation is then started, to maintain the state where the caps 124 are in close contact with the ejection faces 13*a*, thereby preventing the inks in the nozzles from drying. When the printing operation is to be conducted, the maintenance unit 120 is moved to the waiting position in the procedure opposite to that of inserting the maintenance unit 120 to the restoring position.

As described above, in the inkjet printer 100 of the embodiment 2, the transport belt 25 is bent by moving the first roller 22 in order to form the space which enables the maintenance unit 120 to face the ejection faces 13*a*. In other words, when the first roller 22 approaches the second roller 24, the transport belt 25 is bent and the space required for inserting the maintenance unit 120 can be ensured without moving the second roller 24. Therefore, the distance of the downward movement of the first roller 22 is smaller than that in the case where the transport belt 25 is moved without being bent. As a result, the space required for retracting the transport belt 25 can be made small, the internal space of the inkjet printer 100 can be effectively used, and the space required for installing the printer can be reduced.

In the embodiment 2, the maintenance unit 120 conducts only the capping operation. Alternatively, the maintenance unit 120 may be configured so that tubes are connected to the caps 124 and inks in the inkjet heads 12 are discharged by pressure or suction purging. An ink absorbing member or a wiper member for wiping the ejection faces 13*a* may be disposed in the elastic sheet 122. During the movement of the maintenance unit 120 from the waiting position to the restoring position or from the restoring position to the waiting position, the ink absorbing member or the wiper member may wipe the ejection faces 13*a*.

In the embodiment 2, only the first roller 22 is moved. Alternatively, also the second roller 24 may be moved in a direction toward the first roller 22. In the alternative, the amount of bending (amount of flexure) of the transport belt 25 is increased by a degree corresponding to the movement of the second roller 24. Hence, the movement distance of the first roller 22 required for ensuring the space for inserting the maintenance unit 120 can be reduced as compared with the case where the second roller 24 is not moved.

Although preferred embodiments of the invention have been described above, the invention is not restricted to the embodiments. The invention can be adequately modified within the technical scope set forth in the claims.

For example, the above-described transport belt 25 which is a looped belt formed by a sheet-like rubber member may be adequately modified so as to have another shape such as that in which a plurality of strip-like plates are joined together into a loop-like shape.

In Embodiment 1, the guide member (the belt guide roller 32) that guides the bending direction of the transport belt 25 is not required to abut against the transport belt 25 from the inner peripheral face side of the transport belt 25, and may have another configuration in which the guide member abuts against the outer peripheral face of the transport belt 25 to guide the transport belt 25.

In Embodiment 1, the roller moving mechanism 34 that moves the first roller 22 functions also as the guide moving mechanism, which moves the guide member (the belt guide roller 32). Alternatively, the guide moving mechanism may be configured by a mechanism other than the roller moving mechanism 34. In the alternative, the guide moving mechanism must be controlled so as to operate in conjunction with the roller moving mechanism.

What is claimed is:

1. An inkjet printer comprising:

an inkjet head that includes an ejection surface in which an ejection port that ejects ink is defined;

a transport belt that transports a printing medium;

a first roller;

a second roller, wherein the transport belt is wound on the first and second rollers;

a first movement mechanism that moves the first roller between an operating position and a retracting position;

a sealing member;

a second movement mechanism that moves the sealing member between a restoring position where the sealing member covers the ejection port of the ejection surface and a waiting position where the sealing member is separated from the ejection surface;

a control unit that controls the second movement mechanism to move the sealing member from the waiting position to the restoring position when the transport belt is located at the retracting position, wherein:

when the first roller is located at the operating position, the first roller and the second roller support the transport belt so that the transport belt faces the ejection surface; and the sealing member at the waiting position is located on an opposite side of the transport belt from the inkjet head.

2. The inkjet printer according to claim 1, wherein when the first movement mechanism moves the first roller from the operating position to the retracting position, the transport belt is gotten away from the ejection surface while being bent.

3. The inkjet printer according to claim 1, wherein when the sealing member is located at the restoring position, the control unit controls the inkjet head to execute a purge operation.

4. The inkjet printer according to claim 1, wherein:

the inkjet head ejects the ink onto the printing medium, which is arranged to face the ejection surface, to execute printing;

the transport belt carries the printing medium on an outer peripheral surface thereof to transport the printing medium; and the transport belt is an endless-type belt.

5. The inkjet printer according to claim 1, wherein in a projected view in a transport direction of the transport belt, the first roller is gotten more away from the ejection surface as the first roller approaching to the second roller.

6. The inkjet printer according to claim 1, further comprising:

a guide member that is separated from the first roller, and is in contact with the transport belt during the first movement unit moving the first roller from the operating position to the retracting position; and a third movement mechanism that moves the guide member.

7. The inkjet printer according to claim 6, wherein the guide member is in contact with an inner peripheral surface of the transport belt.

8. The inkjet printer according to claim 7, wherein when the first roller is located at the operating position, the guide member is in contact with the inner peripheral surface of the transport belt to support the transport belt.

9. The inkjet printer according to claim 6, further comprising:

a support member that supports the first roller, wherein:

the guide member is disposed on the support member; and the first movement mechanism functions as the third movement mechanism.

10. The inkjet printer according to claim 1, further comprising:

a belt support member that prevents the transport belt from being in contact with the sealing member during the first movement mechanism moving the first roller from the operating position to the retracting position.

11. The inkjet printer according to claim 1, wherein:

the second roller is a driving roller that is transmitted a driving force to be rotated; and the first roller is a driven roller that is transmitted a rotation force generated by the second roller through the transport belt to be rotated.

12. The inkjet printer according to claim 1, wherein when the first roller is located at the operating position, the transport belt is disposed between the ejection surface and the sealing member located at the waiting position.

13. The inkjet printer according to claim 1, wherein the first roller located at the retracting position is closer to the second roller than the first roller located at the operating position.

14. The inkjet printer according to claim 1, wherein the transport belt overlaps with the sealing member at the waiting position and the inkjet head in plan view.

15. The inkjet printer according to claim 1, wherein the transport belt is located between the sealing member at the waiting position and the inkjet head in side view.

16. An inkjet printer, comprising:

an inkjet head that includes an ejection surface in which an ejection port that ejects ink is defined;

a transport belt that transports a printing medium;

a first roller;

a second roller, wherein the transport belt is wound on the first and second rollers;

means for moving the first roller between an operating position and a retracting position;

a sealing member;

means for moving the sealing member between a restoring position where the sealing member covers the ejection port of the ejection surface and a waiting position where the sealing member is separated from the ejection surface;

means for controlling the means that moves the sealing member to move the sealing member from the waiting position to the restoring position when the transport belt is located at the retracting position, wherein:

when the first roller is located at the operating position, the first roller and the second roller support the transport belt so that the transport belt faces the ejection surface; and the sealing member at the waiting position is located on an opposite side of the transport belt from the inkjet head.

17. The inkjet printer according to claim 16, wherein the transport belt overlaps with the sealing member at the waiting position and the inkjet head in plan view.

18. The inkjet printer according to claim 16, wherein the transport belt is located between the sealing member at the waiting position and the inkjet head in side view.

19. A method for sealing an inkjet head of an inkjet printer, the method comprising:

providing the inkjet printer including:

an inkjet head that includes an ejection surface in which an ejection port that ejects ink is defined;

a transport belt that transports a printing medium;

a first roller;

a second roller, wherein the transport belt is wound on the first and second rollers and faces the ejection surface;

a sealing member that is separated from the ejection surface;

moving the first roller from an operating position to a retracting position; and moving the sealing member from a waiting position where the sealing member is located on an opposite side of the transport belt from the inkjet head to a restoring position where the sealing member is in contact with the ejection surface and cover the ejection port.

20. The method according to claim 19, wherein during the moving of the first roller, the transport belt is gotten away from the ejection surface while being bent.

21. The method according to claim 19, wherein the first roller located at the retracting position is closer to the second roller than the first roller located at the operating position.

22. The method according to claim 19, wherein the transport belt overlaps with the sealing member at the waiting position and the inkjet head in plan view.

23. The method according to claim 19, wherein the transport belt is located between the sealing member at the waiting position and the inkjet head in side view.

* * * * *